US010774489B1

(12) United States Patent
Yodock, Jr. et al.

(10) Patent No.: US 10,774,489 B1
(45) Date of Patent: Sep. 15, 2020

(54) FLOOD MITIGATION SYSTEM

(71) Applicants: Leo J. Yodock, Jr., Bloomsburg, PA (US); Guy Yodock, Lakeland, FL (US)

(72) Inventors: Leo J. Yodock, Jr., Bloomsburg, PA (US); Guy Yodock, Lakeland, FL (US)

(73) Assignee: LJ Yodock & Associates, LLC, Miami, FL (US)

( * ) Notice: Subject to any disclaimer, the term of this patent is extended or adjusted under 35 U.S.C. 154(b) by 0 days.

(21) Appl. No.: 16/540,226

(22) Filed: Aug. 14, 2019

(51) Int. Cl.
*E01F 13/00* (2006.01)
*E02B 3/10* (2006.01)

(52) U.S. Cl.
CPC ..... *E02B 3/108* (2013.01)

(58) Field of Classification Search
CPC ..... E02B 3/108; E01F 13/00
USPC ..... 404/6, 7, 8, 9; 256/13.1; 52/586.2, 52/720.1, 721.1, 729.1
See application file for complete search history.

(56) References Cited

U.S. PATENT DOCUMENTS 4,059,362 A * 11/1977 Smith ..... E01F 15/083 404/6
4,113,400 A * 9/1978 Smith ..... E01F 15/083 256/13.1
4,605,336 A * 8/1986 Slaw, Sr. ..... E01D 19/103 404/6
4,665,673 A * 5/1987 Diana ..... B28B 1/008 256/19
4,773,629 A 9/1988 Yodock
4,806,044 A * 2/1989 Duckett ..... E01F 15/006 16/361
4,964,750 A * 10/1990 House ..... E01F 15/0476 404/6
4,986,042 A * 1/1991 Richardt ..... A01G 9/28 52/102
5,118,216 A * 6/1992 Smith ..... E01F 15/083 256/13.1
5,123,773 A * 6/1992 Yodock ..... E01F 15/088 256/13.1
D341,098 S 11/1993 Yodock
5,292,467 A * 3/1994 Mandish ..... E01F 15/0476 256/1
5,452,963 A * 9/1995 Christensen ..... E01F 13/022 256/13.1
5,453,916 A * 9/1995 Tennis ..... E01F 9/669 362/152
5,454,195 A * 10/1995 Hallsten ..... B65D 90/24 220/495.01
5,498,101 A * 3/1996 Braverman ..... E01F 15/086 256/13.1
5,588,786 A * 12/1996 House ..... E01F 8/0011 405/284
D385,362 S * 10/1997 Rossetti ..... D25/38.1
5,836,714 A * 11/1998 Christensen ..... E01F 13/022 404/6

(Continued)

*Primary Examiner* — Edwin J Toledo-Duran
(74) *Attorney, Agent, or Firm* — Thomas L. Kautz; GrayRobinson, P.A.

(57) ABSTRACT

A flood mitigation system comprises a number of barrier units connected end-to-end to form a flood barrier wall wherein each individual barrier unit includes gripping structure along a bottom wall to resist dislocation when impacted by flood water and floating debris and a seal is placed on an end wall of each barrier unit so that the barrier wall resists leakage of flood water between adjacent units.

14 Claims, 7 Drawing Sheets

(56) References Cited

U.S. PATENT DOCUMENTS 5,882,140 A * 3/1999 Yodock, Jr. ..... E01F 15/083 256/13.1
5,938,370 A * 8/1999 Gzybowski ..... E01F 15/083 404/6
5,988,934 A * 11/1999 Wasserstrom ..... E01F 15/083 256/13.1
6,022,172 A * 2/2000 Siyaj ..... E02B 3/108 405/110
6,079,898 A * 6/2000 St. Amant, III ..... A62C 33/06 404/6
6,086,285 A * 7/2000 Christensen ..... E01F 13/022 256/1
D431,082 S * 9/2000 Jaros ..... D25/113
6,164,865 A * 12/2000 McCallum ..... E01F 15/086 404/6
6,413,009 B1 * 7/2002 Duckett ..... E01F 15/083 404/6
6,666,616 B2 * 12/2003 Yodock, III ..... E01F 15/083 256/13.1
6,835,023 B1 * 12/2004 Paterson ..... E01F 15/083 116/63 R
6,843,614 B2 * 1/2005 Yodock, Jr. ..... E01F 13/06 404/6
6,951,434 B2 * 10/2005 Yodock, Jr. ..... E01F 13/02 404/6
7,144,188 B1 * 12/2006 Mallinson ..... E01F 15/086 404/6
D552,250 S * 10/2007 Christensen ..... D25/38.1
7,303,353 B2 * 12/2007 Carey ..... E01F 15/086 404/6
7,351,002 B2 * 4/2008 Yodock, III ..... E01F 15/083 404/6
7,351,008 B2 * 4/2008 Yodock, III ..... B63G 9/00 405/71
D581,551 S * 11/2008 Aoki ..... D25/113
7,537,411 B2 * 5/2009 Yodock, Jr. ..... E01F 15/083 256/13.1
7,600,942 B2 * 10/2009 Yodock, III ..... E01F 15/088 404/6
7,607,645 B2 * 10/2009 Smith ..... E01F 15/088 256/13.1
8,540,456 B2 * 9/2013 Marshall ..... B65D 90/24 405/114
8,864,411 B2 * 10/2014 Taylor ..... E02B 3/108 405/114
8,991,802 B1 * 3/2015 Southworth ..... B25B 1/00 269/43
9,422,681 B2 * 8/2016 Smith ..... E01F 15/083
9,644,377 B1 * 5/2017 Massotte ..... E04G 21/10
2003/0161688 A1 * 8/2003 Frank ..... E02B 3/108 405/115
2004/0156680 A1 * 8/2004 Gibbs ..... E02B 3/06 405/15
2008/0286041 A1 * 11/2008 Yodock, Jr. ..... E01F 15/083 404/6
2010/0008721 A1 * 1/2010 Lass ..... E01F 15/025 404/6
2010/0129156 A1 * 5/2010 Taylor ..... E02B 3/108 405/114
2015/0218763 A1 * 8/2015 Smith ..... E01F 15/083 404/6
2015/0354161 A1 * 12/2015 Adams ..... E06B 9/00 405/116
2018/0230661 A1 * 8/2018 Winters ..... E02B 3/106

* cited by examiner

FLOOD MITIGATION SYSTEM

FIELD OF THE INVENTION

This invention relates to flood mitigation systems, and, more particularly, to a flood barrier wall formed of a number of barrier units having structure along the bottom surface, and end-to-end connections, that collectively resist dislocation when impacted by flood waters and provide substantial protection against the ingress of water there through.

BACKGROUND OF THE INVENTION

It is often highly desirable to locate residences, businesses, farms and other establishments nearby bodies of water such as streams, rivers and lakes for aesthetic and commercial reasons. Depending upon weather conditions, elevation and other factors, many locations experience flooding from time-to-time which can create devastating material damage and life-threatening situations.

Locations that are particularly susceptible to flooding are often at least partially protected by earthen dikes, levees or other permanent structures erected along the banks of a body of water. Despite these measures, flood waters may crest above the level of permanent structures thus exposing establishments and residents to physical danger and economic loss. In other areas where flooding may occur only periodically, permanent flood barrier structures are often not employed at all.

The solution suggested in the prior art to both of the situations noted above is the erection of temporary flood barriers atop permanent structures or along the banks of a body of water with no permanent flood protection. The most common form of temporary flood protection is sand bags which are stacked atop one another to form a wall. The bags are typically made of burlap and filled with sand or other local fill material. While temporary sand bag walls provide some degree of protection from flood waters, they are highly labor intensive and time consuming to construct. Further, the sand bags are usually not reusable and must be disposed of after the flood danger has passed which is costly and creates a disposal problem. Moreover, sand bag walls tend to topple over if the flood water crests at or above the height of such walls, and can become structurally weakened, when saturated, to the point of failure.

A variety of other designs have been proposed in the prior art to mitigate the damage that can be caused by flooding. Inflatable barrier walls have been suggested, such as disclosed in U.S. Pat. Nos. 7,712,998; 5,984,577 and 5,538,360. Wall structures formed of aluminum, plastic or other materials are also common. See, for example, U.S. Pat. Nos. 7,690,865; 6,551,025 and 7,214,005. Further, modular units that are connected end-to-end to form a flood barrier wall have been suggested, such as shown in U.S. Pat. No. 6,394,705.

All of the designs noted above suffer from one or more deficiencies. Those that are intended for a single use, such as sand bags, are of dubious economic value and create a disposal problem. Many temporary structures are bulky, cumbersome to erect and disassemble, and, require substantial space for storage. The cost of storage alone for units that are not needed for relatively long periods of time may be prohibitively expensive for communities, and especially for individual owners of residences and/or businesses.

SUMMARY OF THE INVENTION

This invention is directed to a flood mitigation system comprising a number of barrier units connected end-to-end to form a flood barrier wall wherein each individual unit includes gripping structure along a bottom wall to resist dislocation when impacted by flood water and floating debris.

In one presently preferred embodiment, each of the barrier units is formed of plastic material having a top wall, bottom wall, opposed end walls and opposed side walls interconnected to form a hollow interior which may receive ballast such as sand, water, gravel or combinations thereof. The bottom wall of each barrier unit is formed with a number of spaced channels, extending into the hollow interior toward the top wall, defining gripping elements between them. When the barrier units are placed on a surface such as soil or sand, and filled with ballast, the barrier units may sink downwardly so that the mud, sand or the like from such surface enters the channels of the barrier units and engages their gripping elements to prevent lateral displacement in response to forces exerted by flood water and debris.

In one embodiment, one of the end walls of each barrier unit is formed with an outwardly extending plate or tongue and the opposite end wall has an elongated groove. The barrier units may be positioned end-to-end to form a barrier wall wherein the tongue of one barrier unit extends into the groove of an adjacent unit. Preferably, a seal is provided in the end wall having the tongue in position to engage the end wall of an adjacent barrier unit with the elongated groove when such barrier units are connected together. In an alternative embodiment, each end wall is formed with an elongated groove such that when barrier units are placed end-to-end to form a barrier wall a board or plate may be inserted into the elongated groove of adjacent barriers, spanning two barrier units, to aid in securing them together.

The barrier units employed in the flood mitigation system of this invention are durable, light-weight when not filled with ballast, easy to handle and assemble, and may be used for a number of years.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1A:
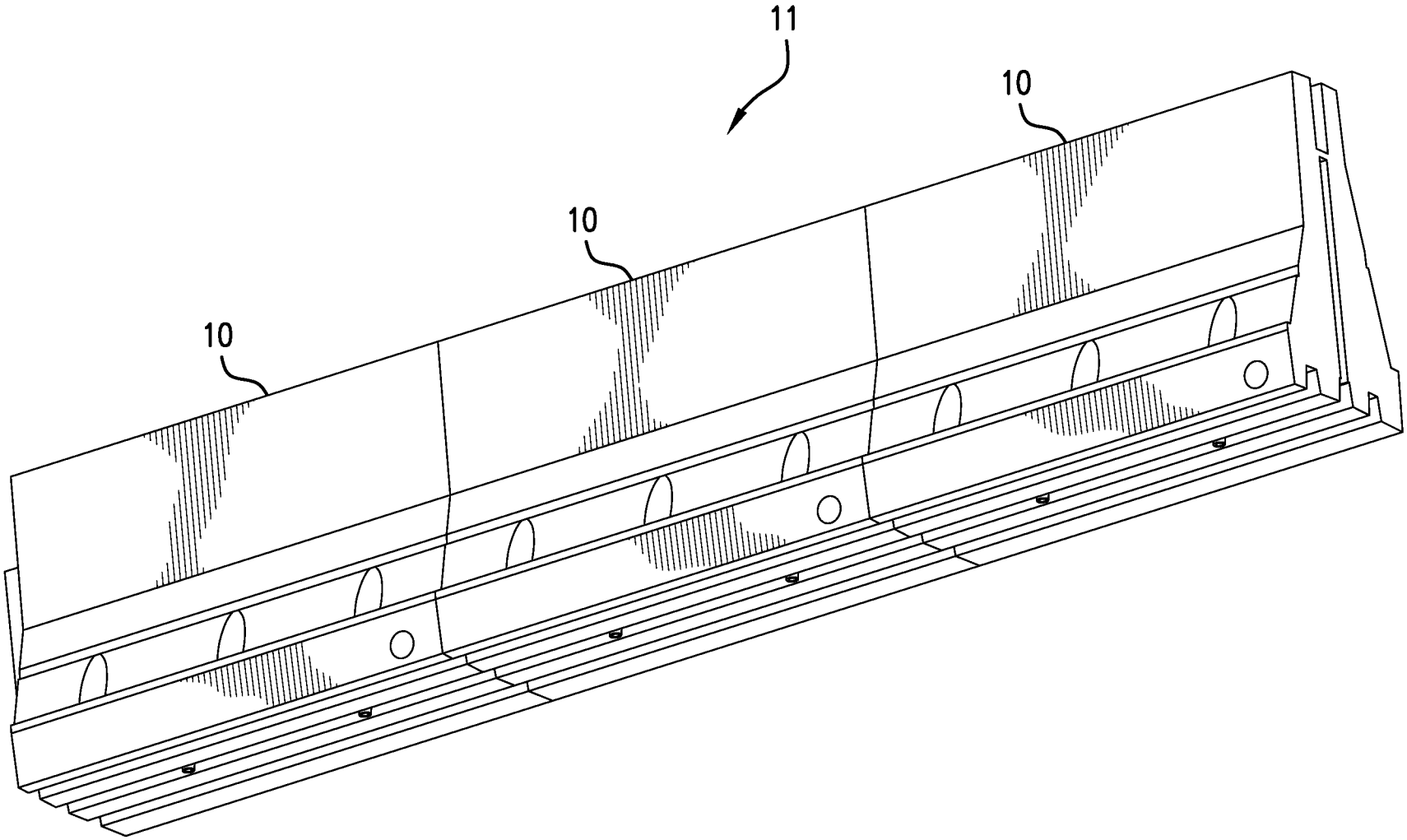
FIG. 1A is a schematic, perspective view of one embodiments of the flood mitigation system of this invention illustrating individual barrier units connected together end-to-end to form a barrier wall.

Referring now to FIGS. 1-5, the flood mitigation system of this invention is formed of a number of barrier units 10 connected end-to-end to form a barrier wall 11 as schematically illustrated in FIG. 1. Each individual barrier unit 10 comprises a top wall 12, a bottom wall 14, opposed end walls 16, 18, and, opposed side walls 20, 22 which are interconnected to collectively define a hollow interior 24. For purposes of the present discussion, the terms "top," "bottom," "upper" and "lower," refer to the vertical orientation of the barrier units 10 as depicted in the Figs. The terms "height," "height dimension," "longer" and "shorter" refer to a dimension measured in a direction between the top and bottom walls 12, 14. The terms "depth" and "depth dimension" refer to a dimension measured in a direction between the side walls 20, 22.

In the presently preferred embodiment, each of the walls 12-22 is formed of a semi-rigid plastic material chosen from the group consisting of low density polyethylene, high density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. Additionally, materials of this type are unaffected by weather and have excellent basic resistance to weathering, leaching and biodegradation. Ultraviolet inhibitors can be added to such materials making them further resistant to the effects of weather. They also retain their mechanical and chemical properties at low ambient temperatures.

The hollow interior 24 of each barrier unit 10 is preferably filled with a ballast material such as water or other liquid, a granular solid material such as sand, gravel and the like, or, combinations thereof. Preferably, the top wall 12 of barrier units 10 is formed with one or more fill holes 13 for insertion of ballast, and the bottom wall 14 may include one or more drain holes 15. The walls 12-22 of barrier units 10 may have a thickness in the range of about ⅛ inch to 1 inch so as to perform satisfactorily in service. In one presently preferred embodiments, the barrier units 10 may have a length in the range of about 6 to 8 feet between end walls 16, 18, a height of about 4 feet between the top and bottom walls 12, 14, and, a depth between the opposed side walls 20, 22 of about 28 inches. At those dimensions, the barrier units have an internal volume of about 31.72 cubic feet and hold about 235 gallons of water.

The side walls 20, 22 of each barrier unit 10 have a somewhat different construction as best seen in FIGS. 2-5. The side wall 20 includes a base section 26 which extends from the bottom wall 14 to a horizontally oriented step or ledge 28. The base section 26 may be tapered or angled inwardly, toward the side wall 22, in a direction from the ledge 28 toward bottom wall 14. The base section 26 may have a vertical height of about 9 inches, measured from the bottom wall 14 upwardly. The horizontal extent of the ledge 28 may be on the order of about 0.75 inches measured in the direction from the outer edge of base section 26 toward the hollow interior 24 of barrier device 10.

Figure 4:
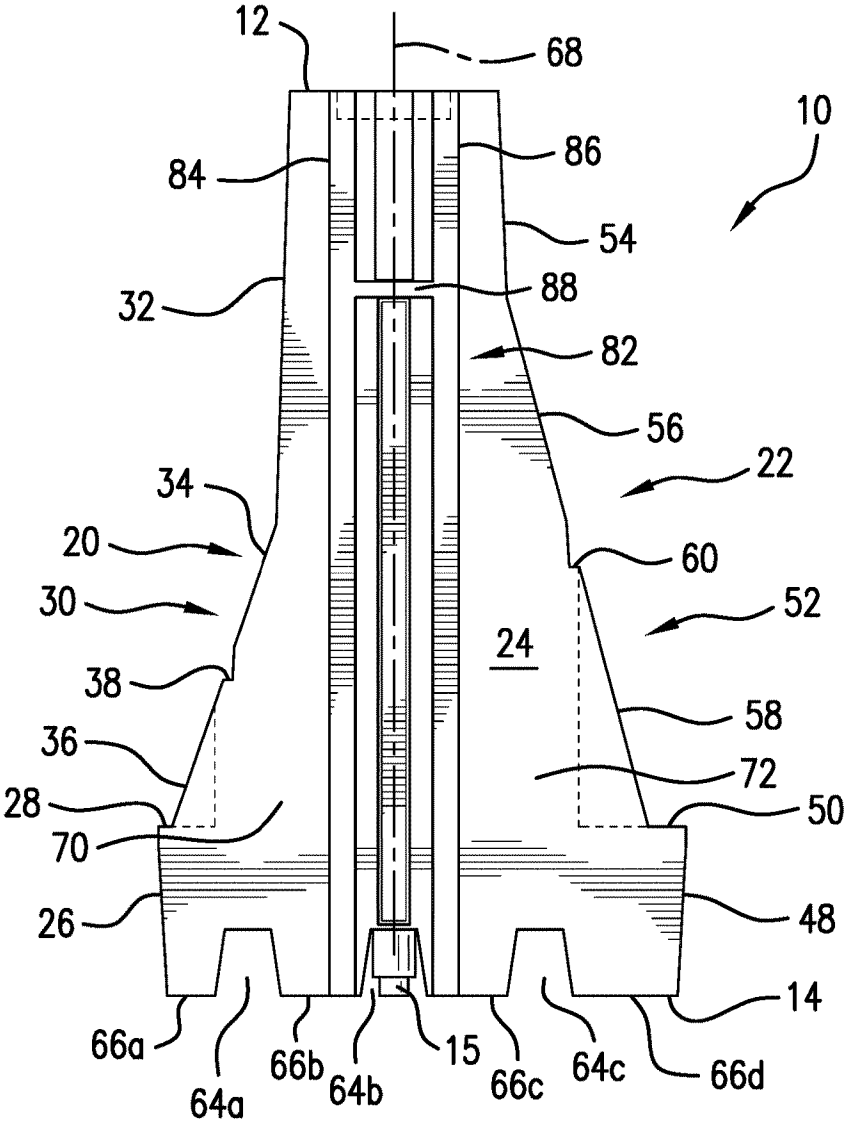
FIG. 4 is an end view of one of the end walls in the barrier unit of FIG. 2.
Figure 5:
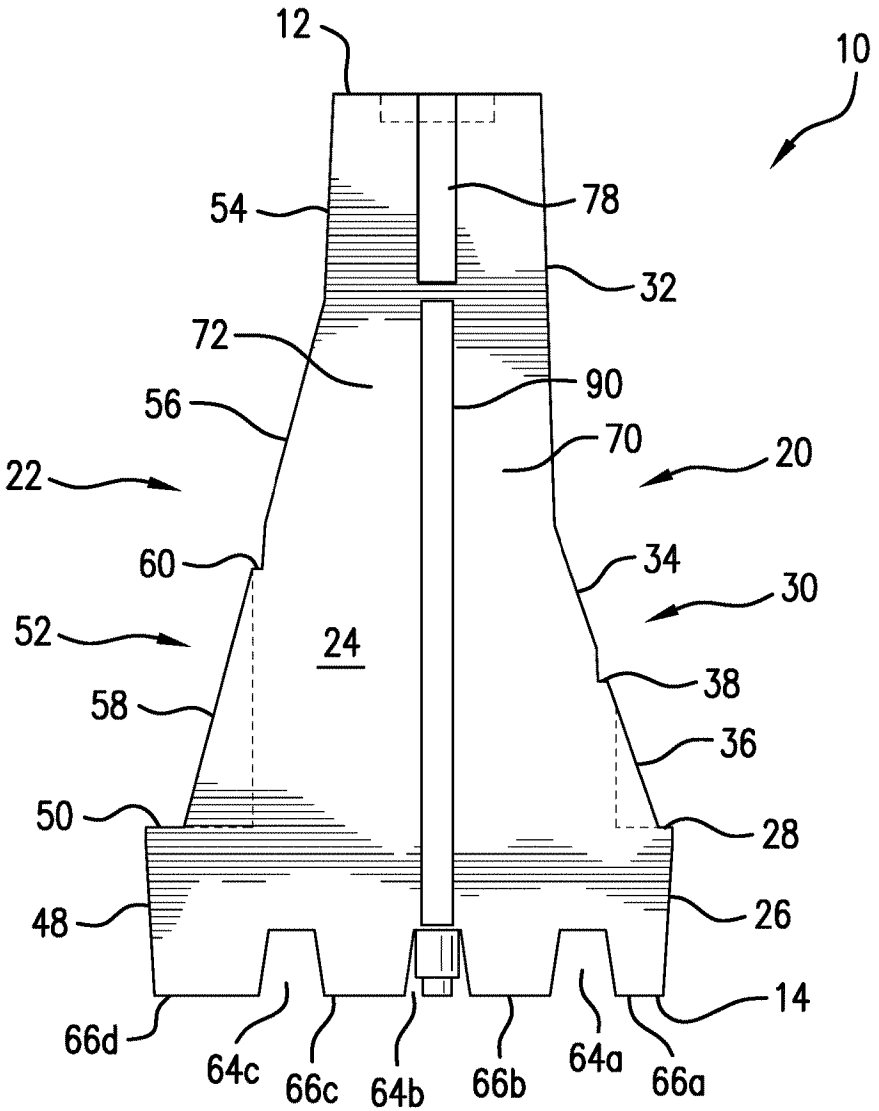
FIG. 5 is a view similar to FIG. 4 except of the opposite end wall.

Extending upwardly from the step 28, in a direction toward top wall 12, is an intermediate section 30 which terminates at an upper section 32. The upper section 32, in turn, is connected between the intermediate section 30 and the top wall 12 of barrier unit 10. As best seen in FIGS. 4 and 5, both the intermediate section 30 and upper section 32 are tapered or angled in a direction toward the side wall 22. The intermediate section 30 has an upper portion 34 joined with the upper section 32 and a lower portion 36 joined with the base section 26. The upper and lower portions 34, 36 of intermediate section 30 are connected by a second ledge 38 which may be about 0.50 inches measured in a direction from the outer edge of lower portion 34 toward side wall 22.

Figure 3:
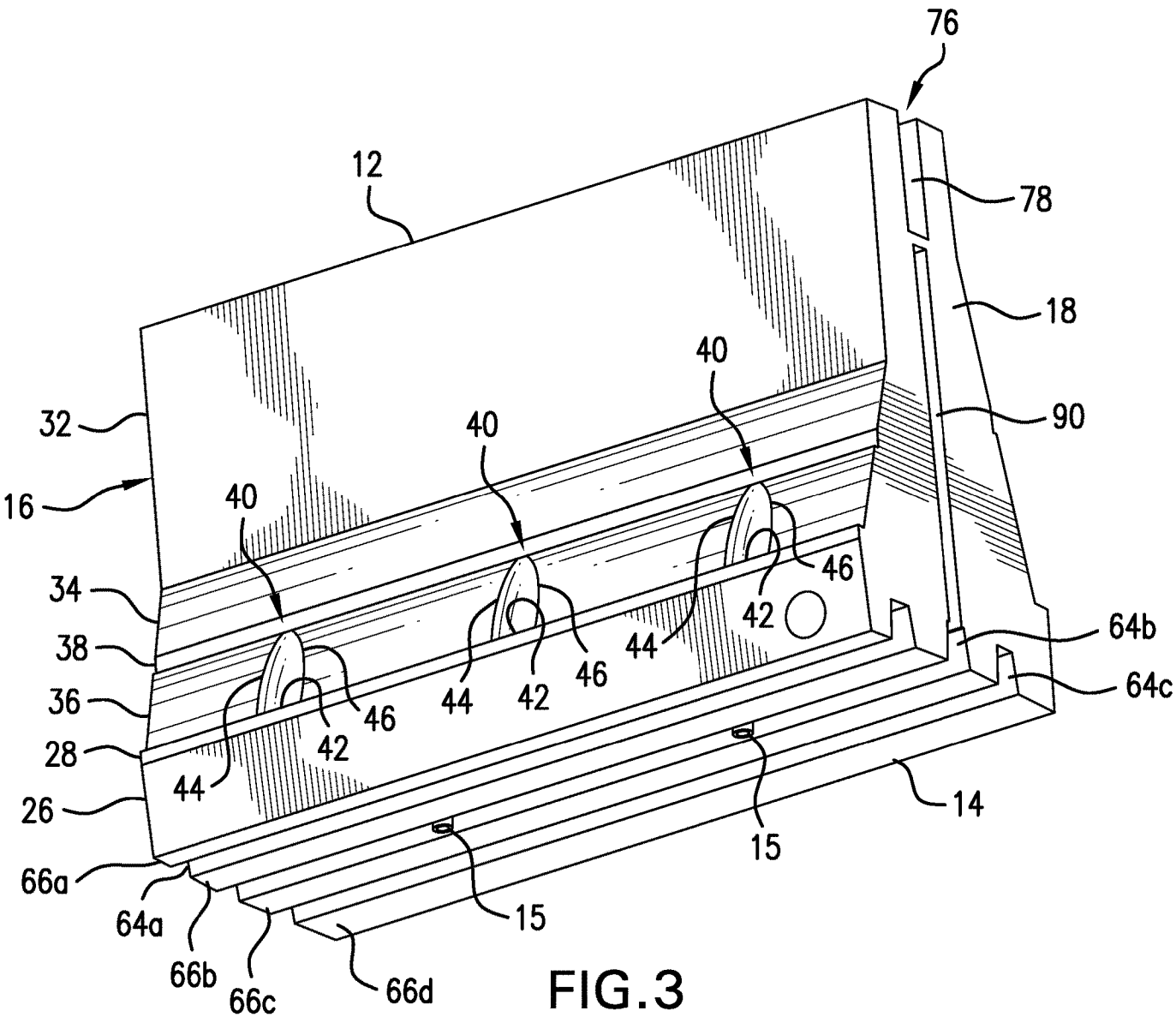
FIG. 3 is a perspective view of the opposite side of the barrier unit shown in FIG. 2.

Referring to FIG. 3, a number of stabilizers 40 are integrally formed in the intermediate section 30 of side wall 20, at regularly spaced intervals between the end walls 16, 18. Each stabilizer 40 includes a floor 42 and opposed sides 44 and 46. The floor 42 of each stabilizer 40 is coplanar with the ledge 28. The sides 44, 46 of each stabilizer 40 taper inwardly, toward one another, in a direction from the floor 42 toward the ledge 38.

The side wall 22 comprises a base section 48 which extends from the bottom wall 14 to a horizontally oriented step or ledge 50. The base section 48 may be tapered or angled inwardly, toward the side wall 20, in a direction from the ledge 50 toward bottom wall 14. The base section 48 may have a vertical height of about 9 inches, measured from the bottom wall 14 upwardly. The horizontal extent of the ledge 50 may be on the order of about 2 inches measured in the direction from the outer edge of base section 48 toward the hollow interior 24 of barrier device 10.

Extending upwardly from the ledge 50, in a direction toward top wall 12, is an intermediate section 52 which terminates at an upper section 54. The upper section 54, in turn, is connected between the intermediate section 52 and the top wall 12 of barrier unit 10. As best seen in FIGS. 4 and 5, both the intermediate section 52 and upper section 54 are tapered or angled in a direction toward the side wall 20. The intermediate section 52 has an upper portion 56 joined with the upper section 54 and a lower portion 58 joined with the base section 48. The upper and lower portions 56, 58 of intermediate section 48 are connected by a second ledge 60 which may be about 0.50 inches measured in a direction from the outer edge of lower portion 58 toward side wall 20. As viewed in FIGS. 4 and 5, the intermediate section 52 of side wall 22 is substantially longer than the intermediate section 30 of side wall 20. The upper section 54 of side wall 22 is substantially shorter than the upper section 32 of side wall 20.

A number of stabilizers 62 are integrally formed in the intermediate section 52 of side wall 22, at regularly spaced intervals between the end walls 16, 18. Each stabilizer 62 includes a floor 64 and opposed sides 66 and 68. The floor 64 of each stabilizer 62 is coplanar with the ledge 50. The sides 66, 68 of each stabilizer 62 taper inwardly, toward one another, in a direction from the floor 64 toward the ledge 60.

In the presently preferred embodiment, the bottom wall 14 of each barrier unit 10 may be formed with a number of channels 64*a*, 64*b* and 64*c* which are spaced from one another in a direction from one side wall 20 to the other side wall 22, and which extend between end walls 16, 18. The channels 64*a-c* protrude into the interior 24 of the barrier units 10, toward top wall 12, preferably at a height of about 3.5 inches. Adjacent channels 64*a-c* define gripping elements 66*a-d* in the bottom wall 14. Specifically, gripping element 66*a* is formed between the bottom section 26 of side wall 20 and channel 64*a*, gripping element 66*b* is located between adjacent channels 64*a* and 64*b*, gripping element 66*c* is formed by channels 64*b* and 64*c*, and, the fourth gripping element 66*d* extends from the channel 64*c* to the bottom section 48 of side wall 22. In one presently preferred embodiment, wherein the depth of the barrier units 10 is 28 inches, each of the channels 64*a-c* may have a depth dimension of 3.5 inches, and the depth of gripping elements 66*a-d* may be 2.56 inches, 4.25 inches, 4.25 inches and 5.56 inches, respectively.

Referring to FIG. 4, a vertical plane 68 is diagrammatically shown in broken lines which bisects the top wall 12 and extends through the hollow interior 24 of barrier unit 10 between the top and bottom walls 12, 14. The hollow interior 24 of barrier unit 10 inherently has an internal volume, and the vertical plane 68 divides it into a first volume 70 and a second volume 72. The first volume is located in the space defined by the top wall 12, bottom wall 14, side wall 20, the vertical plane 68 and end walls 16, 18. The remainder of the volume of hollow interior 24 forms the second volume 72 which is defined by the top and bottom walls 12, 14, the end walls 16, 18 and the space between the vertical plane 68 and side wall 22. As shown in FIG. 4, the vertical plane 68 intersects the bottom wall 14 approximately midway through the channel 64*b*. The cumulative depth dimension of the gripping elements 66*a* and 66*b*, the channel 64*a* and about half of the channel 64*b* is less than the cumulative depth dimension of the gripping elements 66*c* and 66*d*, the channel 64*c* and the remainder of the channel 64*b*.

It is apparent from viewing FIG. 4 that more total volume, and, hence, greater mass when the barrier units 10 are filled with ballast material, is present on the right-hand side of the vertical plane 68 in FIG. 4 (within second volume 72) than the left-hand side of such plane 68 (within first volume 70). The purpose of this construction is to provide a counter-balance against the force of flood water and debris that impact the side wall 20 of barrier units 10 when positioned to form the barrier wall 11. The greater mass within second volume 72, opposite side wall 20, assists in preventing barrier units 10 from tipping over and tends to force the gripping elements 66*c* and 66*d* in a downward direction, toward the ground or other substrate beneath, so that the barrier units 10 better resist lateral displacement when impacted. The greater depth dimension of the gripping elements 66*c* and 66*d* of bottom wall 14 further enhances lateral stability of barrier units 10.

Figure 2:
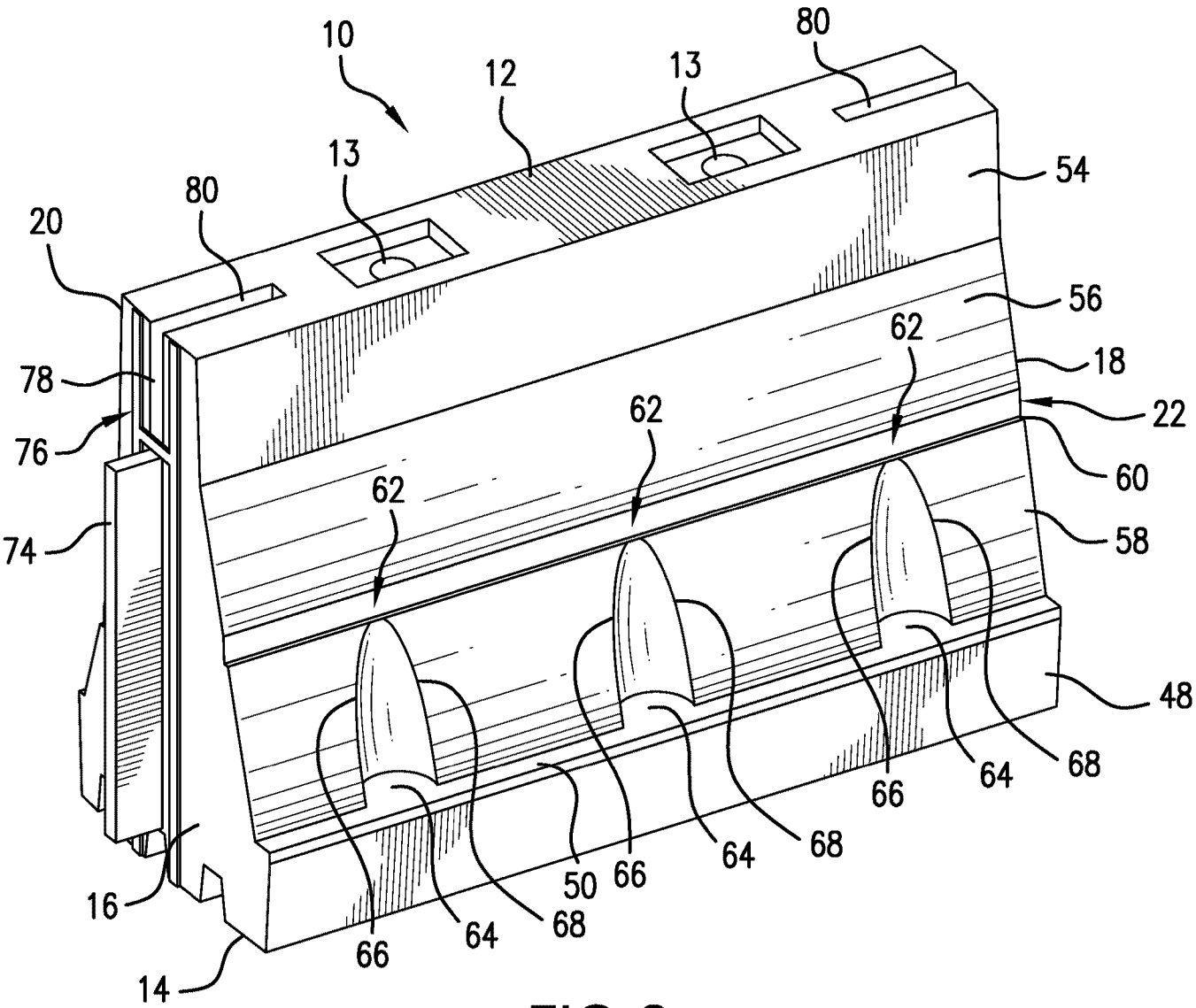
FIG. 2 is a side perspective view of an individual barrier unit employed in the system of FIG. 1.

Referring to FIGS. 2-4, the end wall 16 of each barrier unit 10 is formed with an outwardly protruding plate or tongue 74 which preferably extends from the channel 64*b* to a generally L-shaped slot 76 formed in part of the end wall 16 and top wall 12. Preferably, the slot 76 has a vertical leg 78 formed in the end wall 16, above the top end of tongue 74, which is connected to a horizontal leg 80 formed in the top wall 12. As best seen in FIG. 4, the end wall 16 mounts a seal 82 which comprises a vertical segment 84 extending between the gripping element 66*b* and top wall 12, a second vertical segment 86 located between the gripping element 66*c* and top wall 12, and, a horizontal segment 88. The vertical segments 84, 86 are located on opposite sides of the tongue 74 of end wall 16, and the horizontal segment 88 is connected between the vertical segments 84, 86. Preferably, the seal segments 84-88 protrude outwardly from the surface of the end wall 16 and may be formed of an elastomeric material.

The opposite end wall 18 is formed with an elongated groove 90, and an L-shaped slot 76 as in end wall 16. The elongated groove 90 is located between the channel 64*b* and a point just below the vertical leg 78 of slot 76. See FIG. 5.

Figure 1B:
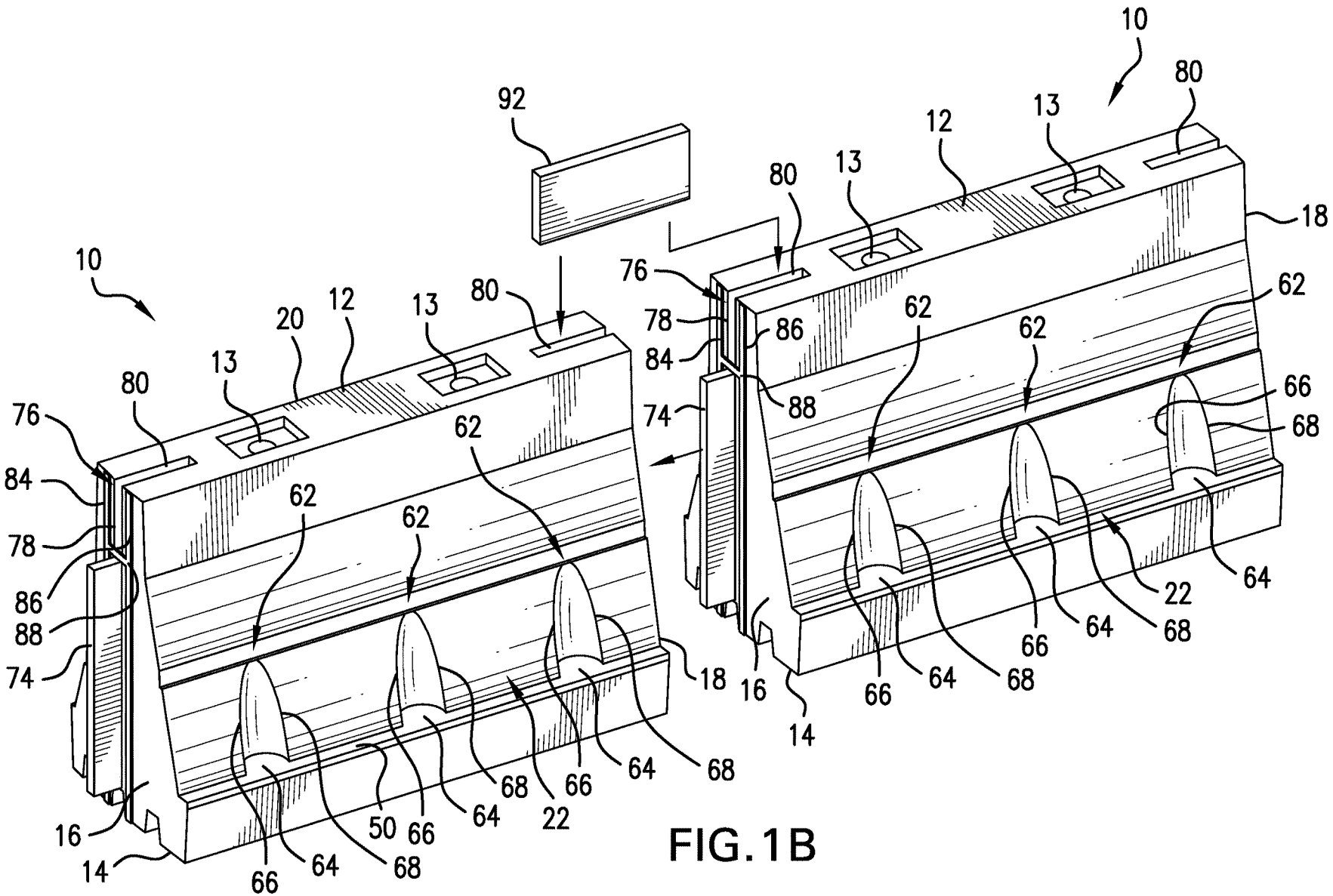
FIG. 1B is side perspective view of two barrier units separated from one another showing a plate or board in position to be inserted within slots formed in each barrier unit when they are connected together.

The elongated groove 90 in the end wall 18 of each barrier unit 10 is positioned and dimensioned to receive and secure the tongue 74 on the end wall 16 of an adjacent barrier unit 10 when they are connected together to form the barrier wall 11. With the tongue 74 seated within elongated groove 90, the segments 84-88 of seal 82 on end wall 16 of one barrier unit 10 contact the facing surface of end wall 18 of an abutting barrier unit 10 to resist the passage of flood water, debris and the like between adjacent barrier units 10. Additionally, as schematically shown in FIG. 1B, a board or plate 92 may be inserted within respective L-shaped slots 76 in the end wall 16 of one barrier unit 10 and the end wall 18 of an adjacent barrier unit 10 when connected end-to-end within barrier wall 11. Such plate 82 spans the adjacent barriers 10 and assists in resisting lateral displacement of the barrier wall 11.

Figure 6:
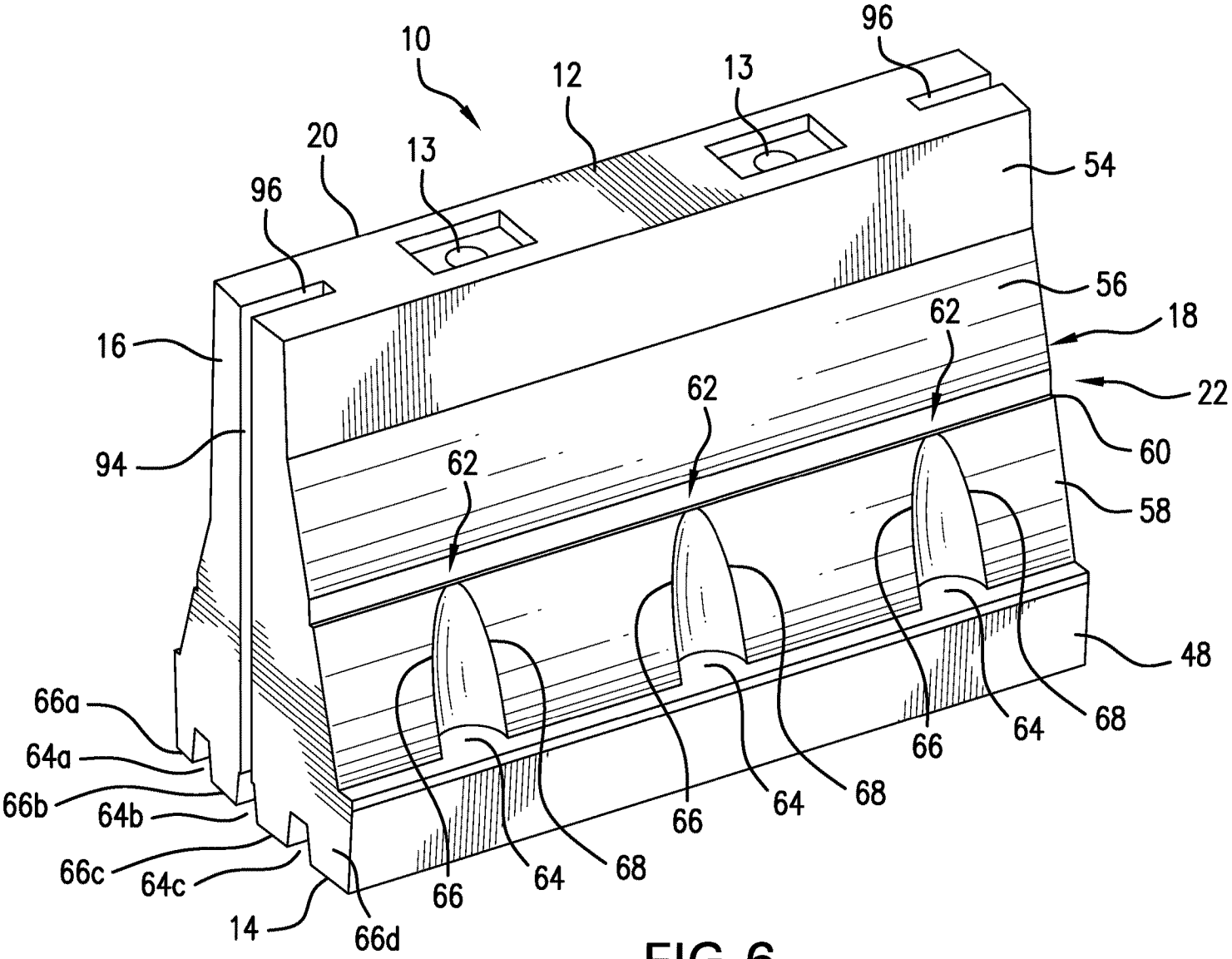
FIG. 6 is a perspective view of an alternative embodiment of structure for connecting adjacent barrier units together in a barrier wall.

Referring now to FIG. 6, and alternative embodiment is illustrated of structure to connect adjacent barrier units 10 together within barrier wall 11. In this embodiment, both of the end walls 16 and 18 are formed with a vertical groove 94 located between the top wall 12 and the channel 64*b*. For ease of illustration, only the end wall 16 is shown in the drawings. A slot 96 is formed in the top wall 12 and connected to the groove 94. A board or plate (not shown) may be inserted within the groove 94 and slot 96 in the end wall 16 of one barrier unit 10, and simultaneously into the elongated groove 94 and slot 96 of an adjacent barrier unit 10, when such units 10 are placed end-to-end within barrier wall 11. The plate or board has sufficient width to span adjacent barrier units 10, and a length to extend along the entire vertical extent of grooves 94, so that it snugly fits within respective grooves 94 and slots 96 of each barrier unit 10. Additionally, the plate or board may be formed with an angle such as 22°, 45° or 90°, so that adjacent barrier units 10 may be oriented at an angle relative to one another in order to follow a curve or other angulation required by the terrain on which the barrier wall 11 is positioned.

The flood mitigation system of this invention resists displacement when impacted with flood water and debris due the construction of its bottom wall 14 and either of the connections between the end walls 16, 18 of adjacent barrier units 10 as described above and shown in the drawings. It is contemplated that on surfaces that have been or will be softened by rain, melting snow or waterway overflow, the barrier units 10 filled with ballast material will sink into such surfaces such that mud, sand and the like may enter channels 64*a*-*c* and engage the gripping elements 66*a*-*d*. The gripping elements 66*a*-*d* have sufficient rigidity and height such that lateral displacement in response to impact by flood water and debris is minimized. Further, the connections between the end walls 16, 18 of adjacent barrier units 10 within barrier wall 11 adds additional resistance to lateral displacement.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. For example, the dimensions of the various elements of barrier units 10 noted above are given by way of example only and in no way limit the scope of this invention.

Therefore, it is intended that the invention not be limited to the particular embodiment disclosed as the best mode contemplated for carrying out this invention, but that the invention will include all embodiments falling within the scope of the appended claims.

What is claimed is:

1. A flood mitigation system, comprising:

a number of barrier units each comprising:

(a) a top wall, a bottom wall, opposed first and second end walls and opposed first and second side walls interconnected to form a hollow interior;

(b) said bottom wall being formed with a number of spaced channels each extending between said opposed first and second end walls, adjacent channels defining a gripping element between them;

(c) a first slot having a first portion formed in said first end wall and a second portion formed in said top wall, and a second slot having a third portion formed in said second end wall and a fourth portion formed in said top wall;

(d) said first end wall being formed with a tongue located between said first portion of said first slot and said bottom wall, said second end wall being formed with an elongated groove located between said third portion of said second slot and said bottom wall;

said barrier units being connected end-to-end to form a barrier wall wherein said gripping elements of each barrier unit are adapted to contact the ground and wherein said tongue of one barrier unit is received within the elongated groove of an adjacent barrier unit to connect them together when forming said barrier wall;

a plate insertable into said first slot of said one barrier unit and into a second slot of said adjacent barrier unit when forming said barrier wall.

2. The flood mitigation system of claim 1 in which said plate is insertable into both of said first and second portions of said first slot of said one barrier unit and into both of said third and fourth portions of said second slot of said adjacent barrier unit.

3. A barrier unit for use in a flood mitigation system, comprising:

a top wall, a bottom wall, opposed first and second end walls and opposed first and second side walls interconnected to form a hollow interior which defines a hollow interior;

said bottom wall being formed with a number of spaced channels each extending between said opposed first and second end walls, adjacent channels defining a gripping element which are spaced between said first and second side walls;

said first end wall being formed with a tongue extending at least partially between said top and bottom walls, said second end wall being formed with an elongated groove;

said first and second side walls being joined to said top wall and spaced from one another such that a vertical plane bisecting said top wall defines a first portion of said internal volume between that part of said hollow interior located between said top and bottom walls, said first and second end walls, said vertical plane and said first side wall, said vertical plane further defining a second portion of said internal volume between that part of said hollow interior between said top and bottom walls, said first and second end walls, said vertical plane and said second side wall, said second portion of said internal volume being greater than said first portion of said internal volume and having a greater mass than said second portion when said barrier unit is filled with a ballast material;

said greater mass of said second portion of said hollow interior of said barrier unit when filled with ballast material being effective to counter-balance forces resulting from the impact of flood water and debris against said first side wall so as to resist tipping over in a direction toward said second side wall.

4. The barrier unit of claim 3 in which said seal comprises a first segment attached to said first end wall between said first side wall and said tongue, and a second segment attached to said first end wall between said second side wall and said tongue.

5. The barrier unit of claim 4 in which said seals further includes a third segment connected between said first and second segments.

6. The barrier unit of claim 5 in which each of said first, second and third segments of said seal is formed of an elastomeric material.

7. The barrier unit of claim 3 in which each of said gripping elements formed in said bottom wall of each of said barrier units has a depth dimension measured in a direction between said first and second side walls, the cumulative depth dimension of said gripping elements located between said vertical plane and said second side wall and beneath said second portion of said internal volume being greater than the cumulative depth dimension of said gripping elements located between said vertical plane and said first side wall and beneath said first portion of said internal volume, said greater mass of said second portion of said internal volume being effective to urge said gripping elements beneath said second portion into the ground so as to resist displacement and tipping over of said barrier units when said first side wall is impacted with flood water and debris.

8. The barrier unit of claim 7 in which each of said channels formed in said bottom wall has a depth dimension measured in a direction between said first and second side walls, said depth dimension of each of said channels being the same.

9. A barrier unit for use in a flood mitigation system, comprising:

a top wall, a bottom wall, opposed first and second end walls and opposed first and second side walls interconnected to form a hollow interior which defines an internal volume;

said bottom wall being formed with a number of spaced channels each extending between said opposed first and second end walls, adjacent channels defining a gripping element which are spaced between said first and second side walls;

each of said first and second end walls being formed with an elongated slot said first and second side walls being joined to said top wall and spaced from one another such that a vertical plane bisecting said top wall defines a first portion of said internal volume between that part of said hollow interior located between said top and bottom walls, said first and second end walls, said vertical plane and said first side wall, said vertical plane further defining a second portion of said internal volume between that part of said hollow interior between said top and bottom walls, said first and second end walls, said vertical plane and said second side wall, said second portion of said internal volume being greater than said first portion of said internal volume and having a greater mass than said second portion when said barrier unit is filled with a ballast material;

said greater mass of said second portion of said hollow interior of said barrier unit when filled with ballast material being effective to counter-balance forces resulting from the impact of flood water and debris against said first side wall so as to resist tipping over in a direction toward said second side wall.

10. A flood mitigation system, comprising:

a number of barrier units each comprising:

(a) a top wall, a bottom wall, opposed first and second end walls and opposed first and second side walls interconnected to form a hollow interior;

(b) said bottom wall being formed with a number of spaced channels each extending between said opposed first and second end walls, adjacent channels defining a gripping element between them;

(c) a first slot having a first portion formed in said first end wall and a second portion formed in said top wall, and a second slot having a third portion formed in said second end wall and a fourth portion formed in said top wall;

(d) said first end wall being formed with a tongue located between said first portion of said first slot and said bottom wall and being spaced from said first portion of said first slot, said second end wall being formed with an elongated groove located between said third portion of said second slot and said bottom wall and being spaced from said third portion of said second slot;

(e) a seal comprising a first segment attached to said first end wall between said first side wall and said tongue and said first portion of said first slot, and a second segment attached to said first end wall between said second side wall and said tongue and said first portion of said first slot;

said barrier units being connected end-to-end to form a barrier wall wherein said gripping elements of each barrier unit are adapted to contact the ground and wherein said tongue of one barrier unit is received within the elongated groove of an adjacent barrier unit to connect them together when forming said barrier wall;

a plate insertable into said first slot of said one barrier unit and into a second slot of said adjacent barrier unit when forming said barrier wall.

11. The flood mitigation system of claim 10 in which said seal further comprises a third segment located in said space between said tongue and said first portion of said first slot, said third segment being connected between said first segment and said second segment, each of said first, second and third segments being formed of an elastomeric material.

12. A flood mitigation system, comprising:

a number of barrier units each comprising:

(a) a top wall, a bottom wall, opposed first and second end walls and opposed first and second side walls interconnected to collectively form a hollow interior which defines an internal volume;

(b) said bottom wall being formed with a number of spaced channels each extending between said opposed first and second end walls, adjacent channels defining a gripping element which are spaced between said first and second side walls;

(c) said first and second side walls being joined to said top wall and spaced from one another such that a vertical plane bisecting said top wall defines a first portion of said internal volume between that part of said hollow interior located between said top and bottom walls, said first and second end walls, said vertical plane and said first side wall, said vertical plane further defining a second portion of said internal volume between that part of said hollow interior between said top and bottom walls, said first and second end walls, said vertical plane and said second side wall, said second portion of said internal volume being greater than said first portion of said internal volume and having a greater mass than said second portion when said barrier unit is filled with a ballast material;

said barrier units being connected end-to-end to form a barrier wall wherein said gripping elements of each barrier unit are adapted to contact the ground;

said greater mass of said second portion of said hollow interior of each barrier unit when filled with ballast material being effective to counter-balance forces resulting from the impact of flood water and debris against said first side wall so as to resist tipping over of said barrier units in a direction toward said second side wall.

13. The flood mitigation system of claim 12 in which each of said gripping elements formed in said bottom wall of each of said barrier units has a depth dimension measured in a direction between said first and second side walls, the cumulative depth dimension of said gripping elements located between said vertical plane and said second side wall and beneath said second portion of said internal volume being greater than the cumulative depth dimension of said gripping elements located between said vertical plane and said first side wall and beneath said first portion of said internal volume, said greater mass of said second portion of said internal volume being effective to urge said gripping elements beneath said second portion into the ground so as to resist displacement and tipping over of said barrier units when said first wall is impacted with flood water and debris.

14. The flood mitigation system of claim 13 in which each of said channels formed in said bottom wall of each of said barrier units has a depth dimension measured in a direction between said first and second side walls, said depth dimension of each of said channels being the same.

* * * * *